US006206774B1

(12) United States Patent
Dexter et al.

(10) Patent No.: US 6,206,774 B1
(45) Date of Patent: Mar. 27, 2001

(54) ROOF ENVIRONMENTAL EXHAUST DUCT

(76) Inventors: Jim Dexter, P.O. Box 23242, Silverthorne, CO (US) 80498; Richard Weinman, P.O. Box 2909, Breckenridge, CO (US) 80424

( * ) Notice: Subject to any disclaimer, the term of this patent is extended or adjusted under 35 U.S.C. 154(b) by 0 days.

(21) Appl. No.: 09/364,354

(22) Filed: Jul. 30, 1999

(51) Int. Cl.[7] ..... F23L 17/02
(52) U.S. Cl. ..... 454/5; 454/30; 454/359
(58) Field of Search ..... 454/5, 30, 353, 454/356, 359, 368

(56) References Cited

U.S. PATENT DOCUMENTS

| | | | | |
|---|---|---|---|---|
| 764,965 | | 7/1904 | Tousley . | |
| 1,053,508 | | 2/1913 | Hiett . | |
| 1,725,971 | | 8/1929 | Zacharias . | |
| 2,060,231 | * | 11/1936 | Malone et al. | 454/30 X |
| 2,695,554 | | 11/1954 | Jenson et al. . | |
| 2,741,972 | | 4/1956 | Pryne | 454/353 X |
| 2,754,748 | | 7/1956 | Daggett . | |
| 2,923,225 | | 2/1960 | Massey . | |
| 3,085,490 | * | 4/1963 | Field | 454/353 X |
| 3,250,206 | | 5/1966 | Strouth . | |
| 3,270,656 | * | 9/1966 | Cood | 454/353 X |
| 3,285,155 | | 11/1966 | Maltenfort . | |
| 3,324,784 | * | 6/1967 | Lambie et al. | 454/356 X |
| 3,472,150 | * | 10/1969 | Strawsine | 454/353 |
| 3,785,271 | * | 1/1974 | Joy | 454/356 |
| 4,151,789 | | 5/1979 | Grobard . | |
| 4,546,919 | | 10/1985 | Wells . | |
| 5,344,363 | | 9/1994 | Pollock . | |
| 5,632,678 | | 5/1997 | Doelfel . | |
| 5,662,522 | | 9/1997 | Waltz | 454/359 |
| 5,711,091 | | 1/1998 | Bos . | |

* cited by examiner

*Primary Examiner*—Harold Joyce
(74) *Attorney, Agent, or Firm*—Oppendahl & Larson LLP

(57) ABSTRACT

An environmental exhaust duct adapted to be mounted on a roof allows for exhaust gases to escape while preventing water and debris from entering the building. The exhaust duct has a flap which is closed over the duct by gravity, and which pivots upwards when exhaust gases are released. A cap over the duct prevents water and debris from entering the air shaft when the flap is open.

8 Claims, 3 Drawing Sheets

ROOF ENVIRONMENTAL EXHAUST DUCT

BACKGROUND OF THE INVENTION

1. Field of the Invention

This invention relates to devices for ventilating building structures, and in particular, to roof mounted, environmental exhaust ducts, i.e. dryer, bathroom, kitchen, range, microwave oven, grill, etc. In particular, the invention relates to environmental moisture-exhaust ducts for assembly with dryer vent hoses commonly used for venting household clothes dryers.

2. Description of the Related Art

Many types and designs of exhaust ducts are known, some of which are specifically designed for venting clothes dryers. Conventional dryer vents have a short tubular section which is installed through an outside wall so that when connected to the dryer vent hose, the exhaust air is expelled outside the house. Various designs of dryer vents are known.

U.S. Pat. No. 2,754,748 (Daggett), U.S. Pat. No. 3,285,155 (Maltenfort) and U.S. Pat. No. 4,151,789 (Grobard) disclose various dryer vents specifically designed for installation in a building wall. U.S. Pat. No. 5,711,091 to Bos discloses a dryer vent specifically designed for mounting in a soffit. U.S. Pat. No. 5,632,678 to Doelfel discloses a roof dryer vent with a downwardly facing air outlet, and a removable lint screen attached to the outlet. Various roof exhaust vents are known, each with some type of cover, and a hinged flap over the air shaft. U.S. Pat. No. 2,741,972 (Pryne), U.S. Pat. No. 3,250,206 (Strouth) and U.S. Pat. No. 5,344,464 (Pollock) disclose roof vents in which the rear wall extends over the air shaft in a dome-like structure to act as a cover. U.S. Pat. No. 5,662,522 to Waltz discloses an exhaust vent suitable for installation in either a roof or wall. The vent of Waltz is complicated and requires many parts, and has a horizontal outside opening to the air shaft.

None of the prior art devices provide a simple, easily manufactured device which allows for ventilating gases through a building roof without obstructing the air flow. It is an object of the instant invention to provide such a roof environmental exhaust duct.

SUMMARY OF THE INVENTION

The roof environmental exhaust duct of the instant invention is designed to allow exhaust gases to be vented through a building roof without obstructing the air flow, eliminating potential lint build-up while preventing rain, snow, birds, rodents, insects and debris from entering the duct. The roof environmental exhaust duct of the invention does not require maintenance or filter cleaning or replacement. In accordance with an embodiment of the instant invention, the roof environmental exhaust duct comprises a hollow tubular member having first and second open ends. The first end is adapted to be inserted into the opening in the roof from the outside and to extend through the opening for delivering exhaust gases from the building to the outside atmosphere. The second end has a smoothly sloping edge extending from a low point arbitrarily designated as the front of the tubular member to a high point arbitrarily designated as the back of the tubular member. First and second vertical support members extend upwards from the sloping edge with free ends remote from the sloping edge. The vertical support members, which may be integral with the tubular member, or distinct parts affixed to the tubular member, are symmetrically disposed about the high point of the sloping edge. A flap is pivotally mounted to the sloping edge of the back of the tubular member between the first and second vertical members such that the flap is gravity biased to close the open second end of the tubular member, wherein the flap is slightly larger than the open second end of the tubular member to prevent the flap from entering the tubular member in the closed position. The flap acts as a back-draft damper to prevent water, birds, rodents, insects and debris from entering the air shaft without the requirement for a screen. A conical cap is attached to the free ends of the vertical supports and spaced apart from the flap to allow the flap to be pushed up by exhaust gases, and the cap extends horizontally beyond the tubular member to prevent water and debris from entering the building through the tubular member.

DETAILED DESCRIPTION OF THE INVENTION

The present invention is directed to an environmental exhaust duct adapted to allow passage of exhaust gases vertically through an opening in the roof of a building or other horizontal surface. The exhaust duct is substantially airtight. The exhaust duct is formed from three main components, a hollow tubular member, a flap and a cap. The hollow tubular member has first and second open ends. The first end is adapted to be inserted into the opening from the outside and to extend through the opening for delivering exhaust gases from the building to the outside atmosphere. The second end has a smoothly sloping edge extending from a low point arbitrarily designated as the front of the tubular member to a high point arbitrarily designated as the back of the tubular member. First and second vertical support members extend upwards from the sloping edge and have free ends remote from the sloping edge. The vertical support members are symmetrically disposed about the high point of the sloping edge. A flap is pivotally mounted to the sloping edge of the back of the tubular member between the first and second vertical members. The flap is gravity-biased to close the open second end of the tubular member, functioning as a back-draft damper. The flap is slightly larger than the open second end of the tubular member to prevent the flap from entering the tubular member in the closed position. A conical cap is attached to the free ends of the vertical supports and is spaced apart from the flap to allow the flap to be pushed up by exhaust gases. The cap extends horizontally beyond the tubular member to prevent water and debris from entering the building through the tubular member.

Figure 1:
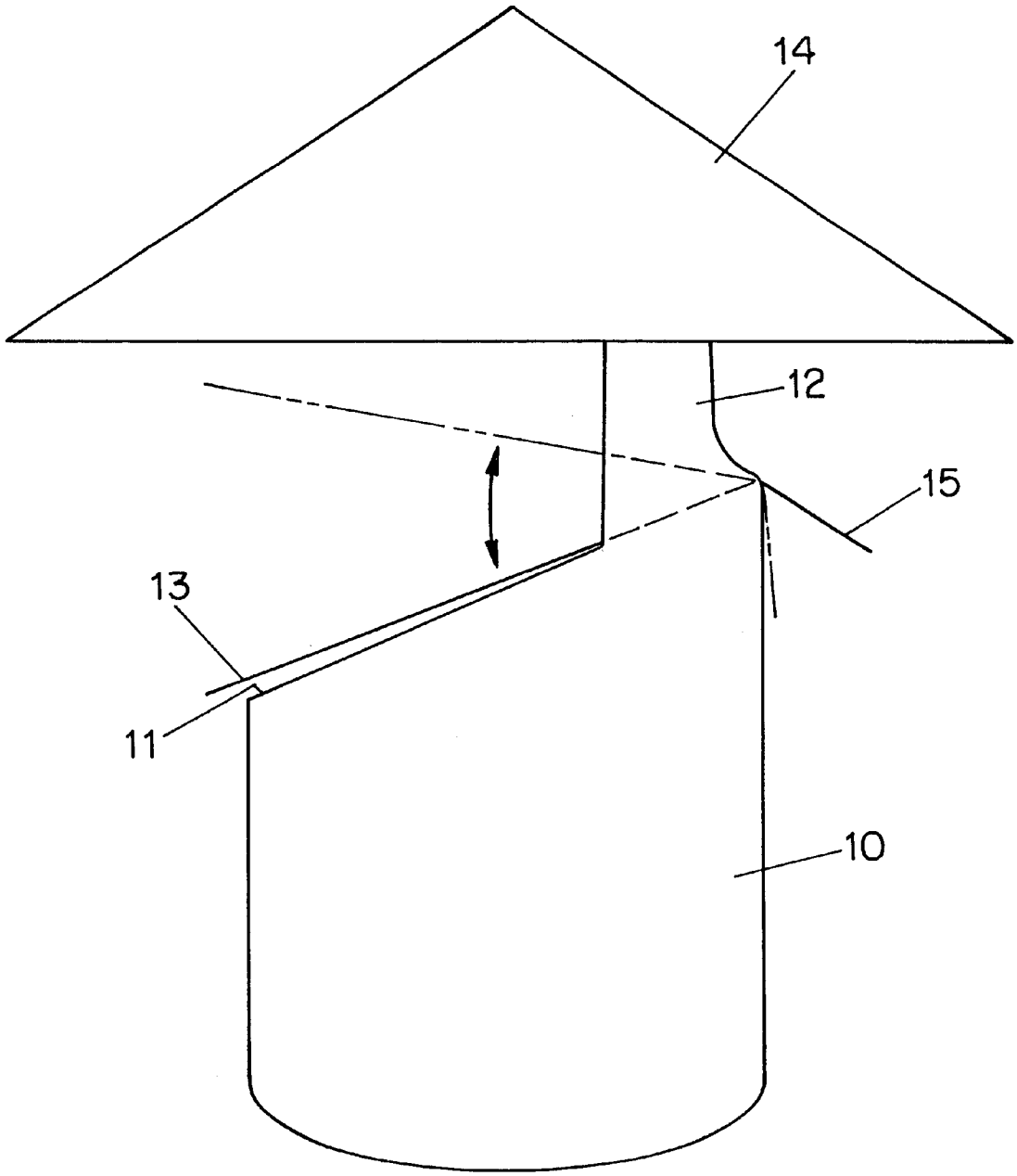
FIG. 1 is a side view of a roof environmental exhaust duct in accordance with the invention.
Figure 2:
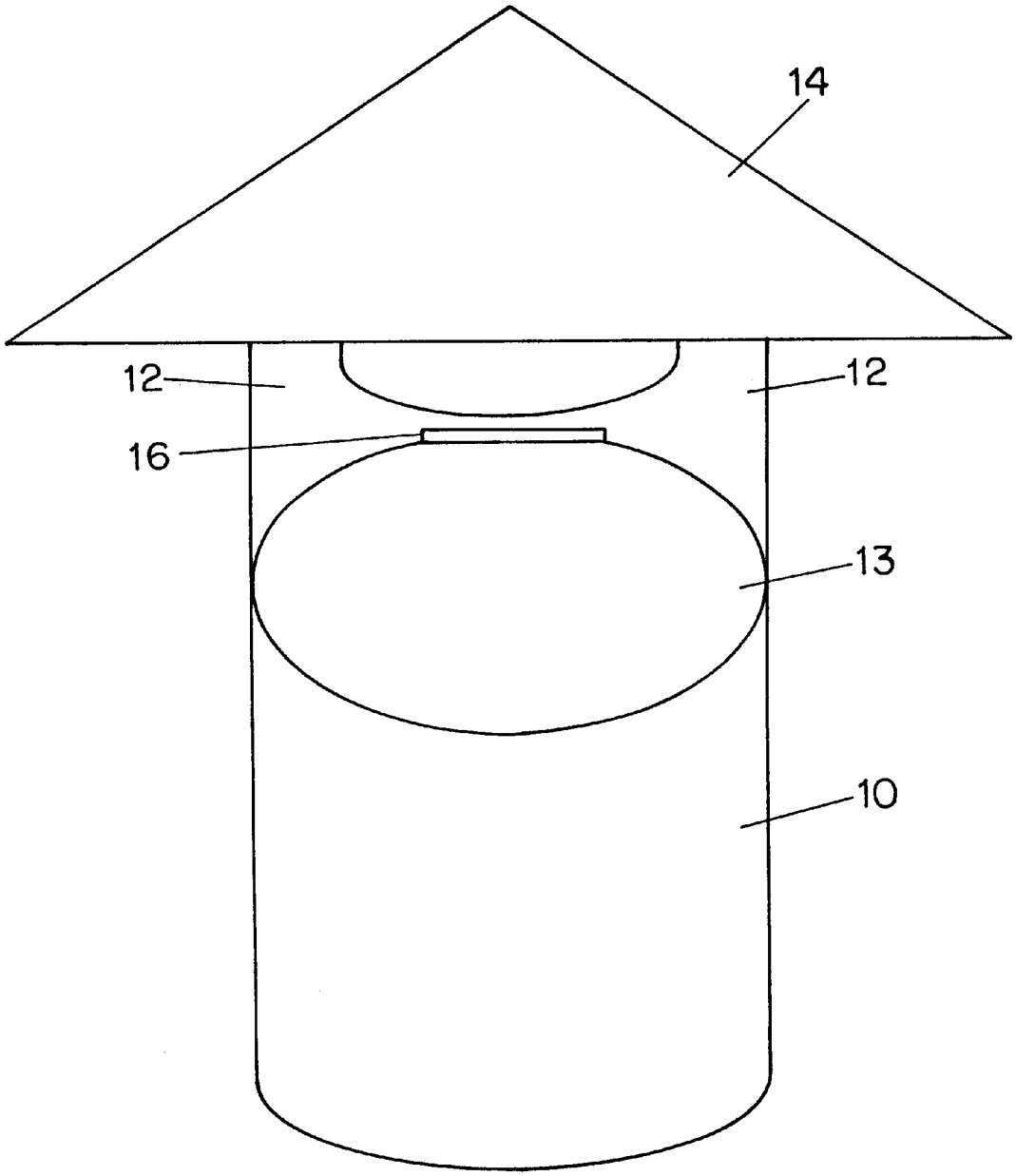
FIG. 2 is a front view of a roof environmental exhaust duct in accordance with the invention.
Figure 3:
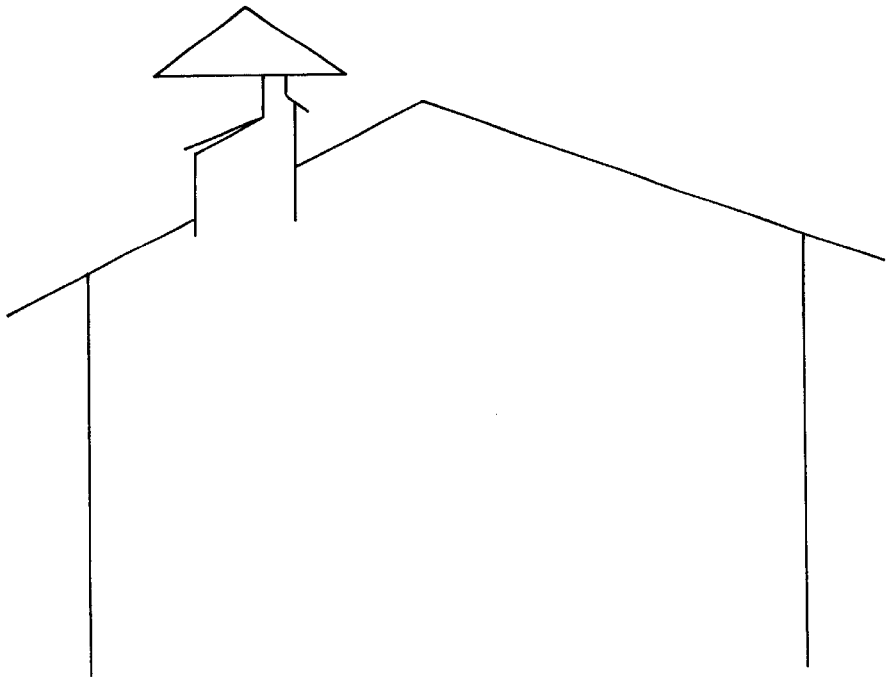
FIG. 3 is a cross-section view of a building with a roof environmental exhaust duct in accordance with the invention.

In the embodiment illustrated in FIGS. 1 and 2, the tubular member and vertical supports are shown as a single piece. However, the tubular member may be made of more than one piece, and the supports may be separate pieces attached to the tubular member. Referring to FIG. 1, the exhaust duct is formed from three components: a tubular member (10) with one end having a smoothly sloping edge (11) and vertical support members (12) extending upwards from the sloping edge, a flap (13), and a cap (14). The sloping edge (11) of the tubular member extends upwards from a low point arbitrarily designated as the front. In the single piece embodiment of FIG. 1, the edge then extends vertically and a section at the back of the tubular member is cut away to create two support members (12), as illustrated most clearly in FIG. 2. The vertical supports in FIGS. 1 and 2 are shown disposed close to the back of the tubular member. This positioning is not critical to the invention, however, provided that the supports do not interfere with movement of the flap (13).

The flap (13) is generally a flat oval with a protrusion (15) at one end. The flap is preferably slightly larger than the opening in the tubular member to prevent the flap from entering the tubular member in the closed position. The overhang of the flap is minimal to prevent wind from catching and lifting the flap. The flap is preferably thinner and lighter than the other parts of the duct so the force of the exhaust air stream will keep the flap in an open position, with no fluttering or banging. A slit (16) is cut in the back of the tubular member to receive the protrusion of the flap. When the flap is in position covering the open end of the tubular member, the protrusion is inserted in the slit (16) and is bent downward. This downward angle limits the range of motion of the flap in the open position, and holds the flap in place. Alternatively, the flap may be attached to the tubular member by a hinge or other means which allows the flap to pivot freely in response to exhaust gases, while not obstructing the air flow.

A conical cap (14), sized to extend horizontally beyond the tubular member, is attached to the vertical support members (12). The cap prevents rain, snow and debris such as leaves, from entering the duct, even when the flap is open. The cap is spaced apart from the sloping edge of the tubular member and flap to allow movement of the flap from a closed position in direct contact with the sloping edge of the tubular member to an open position when exhaust gases are forced up through the duct. The exhaust duct of the invention does not have any obstructions in the air stream which prevents lint build-up when used for venting a clothes dryer, and also minimizes maintenance.

In one embodiment, the free ends of the vertical supports are folded inward to form tabs. The cap is easily attached to the tabs with pop rivets. The cap may also be attached to the supports by spot welding or any other suitable means of joining two pieces of metal.

In a preferred embodiment, the roof environmental exhaust duct is formed from four components: 1) a bottom tubular section, 2) an upper tubular section with sloping edge and vertical support members, 3) a flap, and 4) a cap. The bottom tubular section is sized and adapted to connect to a dryer vent hose. The upper tubular section is shaped similar to the upper portion of the tubular member described above, such that a sloping opening and two vertical supports are formed. The bottom and upper tubular sections are connected to provide a substantially airtight duct with a smooth interior surface. The flap and cap are substantially similar to those described above.

In a further embodiment, the vertical supports are separate elements and are attached to the tubular member such that they support the cap over the duct.

The roof environmental exhaust duct of the invention may be made from any suitable material which can achieve the desired shape and provide a sturdy, weather-resistant structure with a smooth interior surface. The exhaust duct is preferably made of metal, but plastic can also be used. The exhaust duct is designed to be easily and economically assembled from pieces cut from sheet metal. In a preferred embodiment, the bottom tubular section is cut as a rectangle and formed into a tube. The upper tubular section with sloping edge and integrated vertical support members is also cut from sheet metal and then formed into a tube with a horizontal bottom, sloping upper opening, rear slit and upwardly pointing vertical support members. The bottom and upper tubular sections are assembled to form the duct. The flap is an oval with a rectangular protrusion on one end, also cut from sheet metal. The protrusion is inserted into the slit in the upper tubular section, between the supports, and is bent downward at an angle. The cap is a circular piece of sheet metal with a wedge cut out. The ends are overlapped and secured to form a conical cap. The cap is attached to the vertical supports to complete the roof environmental exhaust duct. The exhaust duct may also be made of molded plastic.

The exhaust duct of the instant invention is economical to manufacture because it has few parts and can be made of conventional sheet metal.

Although the preferred embodiment of the device of the invention has been described above in some detail, it should be appreciated that a variety of embodiments will be readily apparent to one skilled in the art. The description of the device of this invention is not intended to be limiting to this invention, but is merely illustrative of the preferred embodiment.

What is claimed is:

1. An environmental exhaust duct adapted to allow passage of exhaust gases through an opening in the roof of a building or other horizontal surface, said exhaust duct comprising a hollow tubular member having first and second open ends, the first end adapted to be inserted into the opening from the outside and to extend through the opening for delivering exhaust gases from the building to the outside atmosphere, said second end having a smoothly sloping edge extending from a low point designated as the front of the tubular member to a high point designated as the back of the tubular member, first and second vertical support members extending upwards from the sloping edge and having free ends remote from the sloping edge, said vertical support members being symmetrically disposed about the high point;

a flap pivotally mounted to the sloping edge of the back of the tubular member between the first and second vertical members such that the flap is gravity biased to close the open second end of the tubular member, wherein the flap is slightly larger than the open second end of the tubular member to prevent the flap from entering the tubular member in the closed position; and a conical cap attached to the free ends of the vertical supports and spaced apart from the flap to allow the flap to be pushed up by exhaust gases, wherein the cap extends horizontally beyond the tubular member to prevent water and debris from entering the building through the tubular member.

2. The exhaust duct of claim 1 wherein the tubular member comprises two sections, a bottom tubular section and an upper tubular section, wherein the upper tubular section has a smoothly sloping edge extending from a low point designated as the front of the upper tubular section to a high point designated as the back of the tubular section, first and second vertical support members extending upwards from the sloping edge and having free ends remote from the sloping edge, said vertical support members being symmetrically disposed about the high point.

3. The exhaust duct of claim 1, wherein the vertical support members are separate elements attached to the tubular member and cap.

4. The exhaust duct of claim 1, wherein the duct is made of sheet metal.

5. A building having a roof having inserted therethrough an environmental exhaust duct adapted to allow passage of exhaust gases through an opening in the roof, said exhaust duct comprising a hollow tubular member having first and second open ends, the first end adapted to be inserted into the opening from the outside and to extend through the opening for delivering exhaust gases from the building to the outside atmosphere, said second end having a smoothly sloping edge extending from a low point designated as the front of the tubular member to a high point designated as the back of the tubular member, first and second vertical support members extending upwards from the sloping edge and having free ends remote from the sloping edge, said vertical support members being symmetrically disposed about the high point;

a flap pivotally mounted to the sloping edge of the back of the tubular member between the first and second vertical members such that the flap is gravity biased to close the open second end of the tubular member, wherein the flap is slightly larger than the open second end of the tubular member to prevent the flap from entering the tubular member in the closed position; and a conical cap attached to the free ends of the vertical supports and spaced apart from the flap to allow the flap to be pushed up by exhaust gases, wherein the cap extends horizontally beyond the tubular member to prevent water and debris from entering the building through the tubular member.

6. The building of claim 5 wherein the tubular member of the exhaust duct comprises two sections, a bottom tubular section and an upper tubular section, wherein the upper tubular section has a smoothly sloping edge extending from a low point designated as the front of the upper tubular section to a high point designated as the back of the tubular section, first and second vertical support members extending upwards from the sloping edge and having free ends remote from the sloping edge, said vertical support members being symmetrically disposed about the high point.

7. The building of claim 5, wherein the vertical support members of the exhaust duct are separate elements attached to the tubular member and cap.

8. The building of claim 5, wherein the exhaust duct is made of sheet metal.

* * * * *

UNITED STATES PATENT AND TRADEMARK OFFICE

CERTIFICATE OF CORRECTION

PATENT NO. : 6,206,774 B1
APPLICATION NO. : 09/364354
DATED : March 27, 2001
INVENTOR(S) : Jim Dexter and Richard Weinman It is certified that error appears in the above-identified patent and that said Letters Patent is hereby corrected as shown below:

On the Title page,

Item [74], "Oppendahl" should read -- Oppedahl --

Signed and Sealed this

Eighteenth Day of May, 2010

David J. Kappos

David J. Kappos
*Director of the United States Patent and Trademark Office*